US009909199B2

(12) United States Patent
Go et al.

(10) Patent No.: US 9,909,199 B2
(45) Date of Patent: Mar. 6, 2018

(54) ALLOYS FOR HIGHLY SHAPED ALUMINUM PRODUCTS AND METHODS OF MAKING THE SAME

(71) Applicant: Novelis Inc., Atlanta, GA (US)

(72) Inventors: Johnson Go, Marietta, GA (US); DaeHoon Kang, Kennesaw, GA (US); Richard Hamerton, Kennesaw, GA (US)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 14/849,698

(22) Filed: Sep. 10, 2015

(65) Prior Publication Data

US 2016/0076126 A1 Mar. 17, 2016

Related U.S. Application Data

(60) Provisional application No. 62/049,445, filed on Sep. 12, 2014.

(51) Int. Cl.

| | |
|---|---|
| ***C22C 21/00*** | (2006.01) |
| ***C22F 1/04*** | (2006.01) |
| ***C22F 1/047*** | (2006.01) |
| ***B22D 7/00*** | (2006.01) |
| ***B22D 15/00*** | (2006.01) |
| ***B22D 21/00*** | (2006.01) |
| ***C22C 21/08*** | (2006.01) |

(52) U.S. Cl.

CPC ..... *C22F 1/047* (2013.01); *B22D 7/005* (2013.01); *B22D 15/00* (2013.01); *B22D 21/007* (2013.01); *C22C 21/00* (2013.01); *C22C 21/08* (2013.01); *C22F 1/04* (2013.01)

(58) Field of Classification Search

CPC ..... C22C 21/00–21/18; C22F 1/04–1/057

See application file for complete search history.

(56) References Cited

U.S. PATENT DOCUMENTS

| | | | | |
|---|---|---|---|---|
| 3,318,738 A | | 5/1967 | Winter | |
| 3,945,860 A | | 3/1976 | Winter et al. | |
| 4,334,935 A | * | 6/1982 | Morris | C22F 1/04 148/437 |
| 4,517,034 A | | 5/1985 | Merchant et al. | |
| 4,526,625 A | | 7/1985 | Merchant et al. | |
| 4,605,448 A | | 8/1986 | Baba et al. | |

(Continued)

FOREIGN PATENT DOCUMENTS

| | | |
|---|---|---|
| CN | 1191578 A | 8/1998 |
| CN | 101186986 A | 5/2008 |

(Continued)

OTHER PUBLICATIONS

International Patent Application No. PCT/US2015/049321, International Search Report and Written Opinion dated Nov. 20, 2015, 10 pages.

(Continued)

*Primary Examiner* — Lois L Zheng

(74) *Attorney, Agent, or Firm* — Kilpatrick Townsend & Stockton LLP

(57) ABSTRACT

Described herein are novel aluminum containing alloys. The alloys are highly formable and can be used for producing highly shaped aluminum products, including bottles and cans.

18 Claims, 2 Drawing Sheets

(56) References Cited

U.S. PATENT DOCUMENTS

| | | | | |
|---|---|---|---|---|
| 5,041,343 | A * | 8/1991 | Fortin | B23K 35/286 148/523 |
| 5,104,459 | A * | 4/1992 | Chen | C22F 1/047 148/437 |
| 5,104,465 | A | 4/1992 | McAuliffe et al. | |
| 5,110,545 | A | 5/1992 | McAuliffe et al. | |
| 5,746,847 | A | 5/1998 | Tanaka et al. | |
| 5,810,949 | A | 9/1998 | Chakrabarti et al. | |
| 6,391,129 | B1 | 5/2002 | Hurd et al. | |
| 6,736,911 | B1 | 5/2004 | Ro et al. | |
| 7,704,451 | B2 | 4/2010 | Kuroda et al. | |
| 7,732,059 | B2 | 6/2010 | Ren et al. | |
| 2006/0014043 | A1* | 1/2006 | Haller | B23K 35/286 428/654 |
| 2008/0302454 | A1 | 12/2008 | Kajihara et al. | |
| 2009/0053099 | A1 | 2/2009 | Kajihara et al. | |
| 2009/0159160 | A1 | 6/2009 | Platek et al. | |
| 2010/0215926 | A1* | 8/2010 | Askin | C25D 11/18 428/209 |
| 2012/0055588 | A1 | 3/2012 | Kamat et al. | |
| 2012/0055591 | A1 | 3/2012 | Kamat et al. | |
| 2012/0298513 | A1 | 11/2012 | Shimao et al. | |
| 2016/0222499 | A1* | 8/2016 | Tundal | C22F 1/05 |

FOREIGN PATENT DOCUMENTS

| | | | |
|---|---|---|---|
| CN | 101433910 | A | 5/2009 |
| EP | 0039211 | B1 | 1/1985 |
| JP | H07256416 | A | 10/1995 |
| JP | 2004244701 | A | 9/2004 |
| WO | 2013133978 | A1 | 9/2013 |
| WO | 2013188668 | A2 | 12/2013 |

OTHER PUBLICATIONS

"International Alloy Designations and Chemical Composition Limits for Wrought Aluminum and Wrought Aluminum Alloys," Feb. 2009, The Aluminum Association, Arlington, VA.

International Patent Application No. PCT/US2015/049321, International Preliminary Report on Patentability dated Mar. 23, 2017, 7 pages.

Chinese Patent Application No. 201580045124.4, Office Action dated Nov. 16, 2017, 25 pages.

* cited by examiner

ALLOYS FOR HIGHLY SHAPED ALUMINUM PRODUCTS AND METHODS OF MAKING THE SAME

CROSS-REFERENCE TO RELATED APPLICATION

This application claims the benefit of U.S. Provisional Patent Application No. 62/049,445, filed Sep. 12, 2014, which is incorporated by reference herein in its entirety.

FIELD OF THE INVENTION

The present invention provides a novel alloy. In one embodiment, the alloy is a highly formable aluminum alloy. The invention further relates to use of the alloy for producing highly shaped aluminum products, including bottles and cans.

BACKGROUND

Formable alloys for use in manufacturing highly shaped cans and bottles are desired. For shaped bottles, the manufacturing process typically involves first producing a cylinder using a drawing and wall ironing (DWI) process. The resulting cylinder is then formed into a bottle shape using, for example, a sequence of full-body necking steps, blow molding, or other mechanical shaping, or a combination of these processes. The demands on any alloy used in such a process or combination of processes are complex. Thus, there is a need for alloys capable of sustaining high levels of deformation during mechanical shaping and/or blow molding for the bottle shaping process and that function well in the DWI process used to make the starting cylindrical preform. In addition, methods are needed for making preforms from the alloy at high speeds and levels of runnability, such as that demonstrated by the current can body alloy AA3104. AA3104 contains a high volume fraction of coarse intermetallic particles formed during casting and modified during homogenization and rolling. These particles play a major role in die cleaning during the DWI process, helping to remove any aluminum or aluminum oxide build-up on the dies, which improves both the metal surface appearance and also the runnability of the sheet.

The other requirements of the alloy are that it must be possible to produce a bottle which meets the targets for mechanical performance (e.g., column strength, rigidity, and a minimum bottom dome reversal pressure in the final shaped product) with lower weight than the current generation of aluminum bottles. The only way to achieve lower weight without significant modification of the design is to reduce the wall thickness of the bottle. This makes meeting the mechanical performance requirement even more challenging.

A final requirement is the ability to form the bottles at a high speed. In order to achieve a high throughput (e.g., 500-600 bottles per minute) in commercial production, the shaping of the bottle must be completed in a very short time. Thus, the materials will be deformed employing a very high strain rate. While aluminum alloys in general are not known to be strain rate sensitive at room temperature, the high temperature formability decreases significantly with increasing strain rate, particularly for Mg-containing alloys. As known to those of skill in the art, the increase in fracture elongation associated with increases in forming temperature in a low strain rate regime diminishes progressively with increasing strain rate.

SUMMARY

Provided herein are novel alloys that display high strain rate formability at elevated temperatures. The alloys can be used for producing highly shaped aluminum products, including bottles and cans. The aluminum alloy described herein includes about 0.25-0.35% Si, 0.40-0.60% Fe, 0-0.40% Cu, 1.10-1.50% Mn, 0-0.76% Mg, 0.001-0.05% Cr, 0-0.3% Zn, up to 0.15% of impurities, with the remainder as Al (all in weight percentage (wt. %)). In some embodiments, the aluminum alloy comprises about 0.25-0.35% Si, 0.40-0.50% Fe, 0.08-0.22% Cu, 1.10-1.30% Mn, 0-0.5% Mg, 0.001-0.03% Cr, 0.07-0.13% Zn, up to 0.15% of impurities, with the remainder as Al (all in weight percentage (wt. %)). In some embodiments, the aluminum alloy comprises about 0.25-0.30% Si, 0.40-0.45% Fe, 0.10-0.20% Cu, 1.15-1.25% Mn, 0-0.25% Mg, 0.003-0.02% Cr, 0.07-0.10% Zn, up to 0.15% of impurities, with the remainder as Al (all in weight percentage (wt. %)). Optionally, the alloy includes Mg in an amount of 0.10 wt. % or less. The alloy can include Mn-containing dispersoids, which can each have a diameter of 1 μm or less. The alloy can be produced by direct chill casting, homogenizing, hot rolling, and cold rolling. In some embodiments, the homogenization step is a two-stage homogenization process. Optionally, the method can include a batch annealing step. Also provided herein are products (e.g., bottles and cans) comprising the aluminum alloy as described herein.

Further provided herein are methods of producing a metal sheet. The methods include the steps of direct chill casting an aluminum alloy as described herein to form an ingot, homogenizing the ingot to form an ingot containing a plurality of Mn-containing dispersoids, hot rolling the ingot containing the plurality of Mn-containing dispersoids to produce a metal sheet, and cold rolling the metal sheet. Optionally, the plurality of Mn-containing dispersoids comprises Mn-containing dispersoids having a diameter of 1 μm or less. In some embodiments, the homogenizing step is a two-stage homogenizing process. The two-stage homogenizing process can include heating the ingot to a peak metal temperature of at least 600° C., allowing the ingot to stand at the peak metal temperature for four or more hours, cooling the ingot to a temperature of 550° C. or lower, and allowing the final ingot to stand for up to 20 hours. Optionally, the method can include a batch annealing step. Products (e.g., bottles or cans) obtained according to the methods are also provided herein.

Other objects and advantages of the invention will be apparent from the following detailed description of embodiments of the invention.

BRIEF DESCRIPTION OF THE FIGURES

In FIG. 2A, "3104" represents comparison alloy AA3104 and "LC," "H2," "0.2 Mg," and "0.5 Mg" represent the prototype alloys.

In FIG. 2B, "3104" represents comparison alloy AA3104 and "LC," "H2," "0.2 Mg," and "0.5 Mg" represent the prototype alloys.

DETAILED DESCRIPTION

Figure 1A:
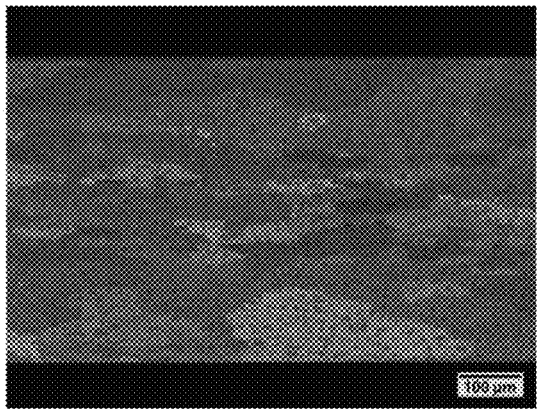
FIG. 1A is a photograph showing the recrystallized grain structure of Mn-containing dispersoid samples that were homogenized using the conventional low temperature cycle at approximately 540° C.

In the commercial manufacturing of aluminum cans and bottles, the shaping processes of the materials should be carried out at a high speed to achieve the throughput required to make the process economically feasible. Furthermore, the application of elevated temperature during forming may be required to form containers with more complicated shapes and larger, expanded diameters, as desired by brand owners and consumers. Hence, it is imperative that the materials used for such application are capable of achieving high formability when deformed at high strain rates and elevated temperatures.

During warm forming, two important microstructural processes occur concurrently: recovery and work hardening. However, the two processes impose opposite effects on the total dislocation density of the materials. While the recovery process reduces the dislocation density in the matrix by reorganizing the dislocation configuration, work hardening increases the dislocation density by generating new dislocations. When the rates of the two processes reach the same magnitude, the elongation of the materials is greatly enhanced.

Definitions and Descriptions

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," and "the" includes singular and plural references unless the context clearly dictates otherwise.

In the following embodiments, the aluminum alloys are described in terms of their elemental composition in weight percent (wt. %). In each alloy, the remainder is aluminum, with a maximum wt. % of 0.15% for the sum of all impurities.

Alloy Composition

Described herein is a new aluminum alloy which exhibits good high strain rate formability at elevated temperatures (e.g., at temperatures up to 250° C.). As used herein, "high strain rate" refers to a strain rate of at least 0.5 $s^{-1}$. For example, a high strain rate can be at least 0.5 $s^{-1}$, at least 0.6 $s^{-1}$, at least 0.7 $s^{-1}$, at least 0.8 $s^{-1}$, or at least 0.9 $s^{-1}$.

The alloy compositions described herein are aluminum-containing alloy compositions. The alloy compositions exhibit good high strain rate formability at elevated temperatures. The high strain rate formability is achieved due to the elemental compositions of the alloys. Specifically, an alloy as described herein can have the following elemental composition as provided in Table 1. The components of the composition are provided in terms of weight percentage (wt. %) based on the total weight of the alloy.

TABLE 1

| Element | Weight Percentage (wt. %) |
|---|---|
| Si | 0.25-0.35 |
| Fe | 0.40-0.60 |
| Cu | 0-0.40 |
| Mn | 1.10-1.50 |
| Mg | 0-0.76 |
| Cr | 0.001-0.05 |
| Zn | 0-0.3 |
| Ti | 0-0.10 |
| Others | 0-0.03 (each)<br>0-0.15 (total) |
| Al | Remainder |

In some embodiments, the alloy as described herein can have the following elemental composition as provided in Table 2. The components of the composition are provided in terms of weight percentage (wt. %) based on the total weight of the alloy.

TABLE 2

| Element | Weight Percentage (wt. %) |
|---|---|
| Si | 0.25-0.35 |
| Fe | 0.40-0.50 |
| Cu | 0.08-0.22 |
| Mn | 1.10-1.30 |
| Mg | 0-0.50 |
| Cr | 0.001-0.03 |
| Zn | 0.07-0.13 |
| Ti | 0-0.10 |
| Others | 0-0.03 (each)<br>0-0.15 (total) |
| Al | Remainder |

In some embodiments, the alloy as described herein can have the following elemental composition as provided in Table 3. The components of the composition are provided in terms of weight percentage (wt. %) based on the total weight of the alloy.

TABLE 3

| Element | Weight Percentage (wt. %) |
|---|---|
| Si | 0.25-0.30 |
| Fe | 0.40-0.45 |
| Cu | 0.10-0.20 |
| Mn | 1.15-1.25 |
| Mg | 0-0.25 |
| Cr | 0.003-0.02 |
| Zn | 0.07-0.10 |
| Ti | 0-0.10 |
| Others | 0-0.03 (each)<br>0-0.15 (total) |
| Al | Remainder |

In some embodiments, the alloy described herein includes silicon (Si) in an amount of from 0.25% to 0.35% (e.g., from 0.25% to 0.30% or from 0.27% to 0.30%) based on the total weight of the alloy. For example, the alloy can include 0.25%, 0.26%, 0.27%, 0.28%, 0.29%, 0.30%, 0.31%, 0.32%, 0.33%, 0.34%, or 0.35% Si. All expressed in wt. %.

In some embodiments, the alloy described herein also includes iron (Fe) in an amount of from 0.40% to 0.60% (e.g., from 0.40% to 0.5% or from 0.40% to 0.45%) based on the total weight of the alloy. For example, the alloy can include 0.40%, 0.41%, 0.42%, 0.43%, 0.44%, 0.45%, 0.46%, 0.47%, 0.48%, 0.49%, 0.50%, 0.51%, 0.52%, 0.53%, 0.54%, 0.55%, 0.56%, 0.57%, 0.58%, 0.59%, or 0.60% Fe. All expressed in wt. %.

In some embodiments, the alloy described includes copper (Cu) in an amount of up to 0.40% (e.g., from 0.08% to 0.22% or from 0.10% to 0.20%) based on the total weight of the alloy. For example, the alloy can include 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, 0.20%, 0.21%, 0.22%, 0.23%, 0.24%, 0.25%, 0.26%, 0.27%, 0.28%, 0.29%, 0.30%, 0.31%, 0.32%, 0.33%, 0.34%, 0.35%, 0.36%, 0.37%, 0.38%, 0.39%, or 0.40% Cu. In some embodiments, Cu is not present in the alloy (i.e., 0%). All expressed in wt. %.

In some embodiments, the alloy described herein can include manganese (Mn) in an amount of from 1.10% to 1.50% (e.g., from 1.10% to 1.30% or from 1.15% to 1.25%) based on the total weight of the alloy. For example, the alloy can include 1.10%, 1.11%, 1.12%, 1.13%, 1.14%, 1.15%, 1.16%, 1.17%, 1.18%, 1.19%, 1.20%, 1.21%, 1.22%, 1.23%, 1.24%, 1.25%, 1.26%, 1.27%, 1.28%, 1.29%, 1.30%, 1.31%, 1.32%, 1.33%, 1.34%, 1.35%, 1.36%, 1.37%, 1.38%, 1.39%, 1.40%, 1.41%, 1.42%, 1.43%, 1.44%, 1.45%, 1.46%, 1.47%, 1.48%, 1.49%, or 1.50% Mn. All expressed in wt. %. The inclusion of Mn in the alloys described herein in an amount of from 1.10% to 1.50% is referred to as a "high Mn content." As described further below and as demonstrated in the Examples, the high Mn content results in the desired precipitation of fine Mn-containing dispersoids during the homogenization cycle.

The high Mn content has a two-fold effect on the properties of the materials. First, a high Mn content results in a high strength alloy. Mn is a solid solution or precipitation hardening element in aluminum. Higher Mn content in the solid solution results in a higher strength of the final alloy. Second, a high Mn content results in an alloy with high formability properties. Specifically, Mn atoms combine with Al and Fe atoms to form dispersoids (i.e., Mn-containing dispersoids) during the homogenization cycle. Without being bound by theory, these fine and homogeneously distributed dispersoids pin grain boundaries during recrystallization, which allows the refinement of grain size and the formation of a more uniform microstructure. During recrystallization, grain boundaries are attracted to these fine Mn-containing dispersoids because when a grain boundary intersects a particle, a region of the boundary equal to the intersection area is effectively removed. In turn, a reduction in the free energy of the overall system is achieved. In addition to refining grain size, the fine Mn-containing dispersoids improve the material's resistance to grain boundary failure by reducing the dislocation slip band spacing. The fine Mn-containing dispersoids also reduce the tendency to form intense shear bands during deformation. As a consequence of these positive effects of the Mn-containing dispersoids, the overall formability of the materials is improved.

Magnesium (Mg) can be included in the alloys described herein to attain a desired strength requirement. However, in the alloys described herein, the total elongation of the materials is significantly improved by controlling the Mg content to an acceptable limit. Optionally, the alloy described herein can include Mg in an amount of up to 0.76% (e.g., up to 0.5% or up to 0.25%). In some embodiments, the alloy can include 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, 0.3%, 0.31%, 0.32%, 0.33%, 0.34%, 0.35%, 0.36%, 0.37%, 0.38%, 0.39%, 0.4%, 0.41%, 0.42%, 0.43%, 0.44%, 0.45%, 0.46%, 0.47%, 0.48%, 0.49%, 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, or 0.76% Mg. In some embodiments, the alloy described herein can include less than 0.76% Mg. For example, in some embodiments, Mg is present in an amount of 0.5% Mg or less. In some embodiments, Mg is present in an amount of 0.25% or less, 0.20% or less, 0.15% or less, 0.10% or less, 0.05% or less or 0.01% or less. In some embodiments, Mg is not present in the alloy (i.e., 0%). All expressed in wt. %.

The inclusion of Mg in the alloys described herein in an amount of up to 0.50% (e.g., up to 0.25%) is referred to as a "low Mg content." As described further below and as demonstrated in the Examples, the low Mg content results in the desired high strain rate formability at elevated temperatures (e.g., at temperatures of up to 250° C.) and an improved elongation of the materials.

In some embodiments, the alloy described herein includes chromium (Cr) in an amount of from 0.001% to 0.05% (e.g., from 0.001% to 0.03% or from 0.003% to 0.02%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.041%, 0.042%, 0.043%, 0.044%, 0.045%, 0.046%, 0.047%, 0.048%, 0.049%, or 0.05% Cr. All expressed in wt. %.

In some embodiments, the alloy described herein includes zinc (Zn) in an amount of up to 0.30% (e.g., from 0.07% to 0.30%, from 0.05% to 0.13%, or from 0.07% to 0.10%) based on the total weight of the alloy. For example, the alloy can include 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, or 0.3% Zn. In some embodiments, Zn is not present in the alloy (i.e., 0%). All expressed in wt. %.

In some embodiments, the alloy described herein includes titanium (Ti) in an amount of up to 0.10% (e.g., from 0% to 0.10%, from 0.01% to 0.09%, or from 0.03% to 0.07%) based on the total weight of the alloy. For example, the alloy can include 0.01%, 0.02%, 0.03%, 0.04%, 0.05%, 0.06%, 0.07%, 0.08%, 0.09%, or 0.10% Ti. In some embodiments, Ti is not present in the alloy (i.e., 0%). All expressed in wt. %.

Optionally, the alloy compositions described herein can further include other minor elements, sometimes referred to as impurities, in amounts of 0.03% or below, 0.02% or below, or 0.01% or below, each. These impurities may include, but are not limited to, V, Zr, Ni, Sn, Ga, Ca, or combinations thereof. Accordingly, V, Zr, Ni, Sn, Ga, or Ca may each be present in alloys in amounts of 0.03% or below, 0.02% or below, or 0.01% or below. In general, the impurity levels are below 0.03% for V and below 0.01% for Zr. In some embodiments, the sum of all impurities does not exceed 0.15% (e.g., 0.10%). All expressed in wt. %. The remaining percentage of the alloy is aluminum.

Methods of Making

The alloys described herein can be cast into ingots using a Direct Chill (DC) process. The DC casting process is performed according to standards commonly used in the aluminum industry as known to one of ordinary skill in the art. In some embodiments, to achieve the desired microstructure, mechanical properties (e.g., high formability), and physical properties of the products, the alloys are not processed using continuous casting methods. The cast ingot can then be subjected to further processing steps to form a metal sheet. In some embodiments, the processing steps include subjecting the metal ingot to a two-step homogenization cycle, a hot rolling step, an annealing step, and a cold rolling step.

The homogenization is carried out in two stages to precipitate Mn-containing dispersoids. In the first stage, an ingot prepared from the alloy compositions described herein is heated to attain a peak metal temperature of at least 575° C. (e.g., at least 600° C., at least 625° C., at least 650° C., or at least 675° C.). The ingot is then allowed to soak (i.e., held at the indicated temperature) for a period of time during the first stage. In some embodiments, the ingot is allowed to soak for up to 10 hours (e.g., for a period of from 30 minutes to 10 hours, inclusively). For example, the ingot can be soaked at the temperature of at least 575° C. for 30 minutes, 1 hour, 2 hours, 3 hours, 4 hours, 5 hours, 6 hours, 7 hours, 8 hours, 9 hours, or 10 hours.

In the second stage, the ingot can be cooled to a temperature lower than the temperature used in the first stage. In some embodiments, the ingot can be cooled to a temperature of 550° C. or lower. For example, the ingot can be cooled to a temperature of from 400° C. to 550° C. or from 450° C. to 500° C. The ingot can then be soaked for a period of time during the second stage. In some embodiments, the ingot is allowed to soak for up to 20 hours (e.g., 1 hour or less, 2 hours or less, 3 hours or less, 4 hours or less, 5 hours or less, 6 hours or less, 7 hours or less, 8 hours or less, 9 hours or less, 10 hours or less, 11 hours or less, 12 hours or less, 13 hours or less, 14 hours or less, 15 hours or less, 16 hours or less, 17 hours or less, 18 hours or less, 19 hours or less, or 20 hours or less).

The two-step homogenization cycle results in the precipitation of Mn-containing dispersoids. Optionally, the Mn-containing dispersoids have a diameter of 1 μm or less. For example, the diameter of the Mn-containing dispersoids can be 1 μm or less, 0.9 μm or less, 0.8 lam or less, 0.7 μm or less, 0.6 μm or less, 0.5 μm or less, 0.4 μm or less, 0.3 μm or less, 0.2 μm or less, or 0.1 μm or less. Optionally, the Mn-containing dispersoids are homogenously dispersed throughout in the aluminum matrix. The Mn-containing dispersoids precipitated according to the size and distribution described herein can control grain size during subsequent steps, such as during recrystallization annealing.

Following the two-step homogenization cycle, a hot rolling step can be performed. In some embodiments, the ingots can be hot rolled to a 5 mm thick gauge or less. For example, the ingots can be hot rolled to a 4 mm thick gauge or less, 3 mm thick gauge or less, 2 mm thick gauge or less, or 1 mm thick gauge or less. To obtain an appropriate balance of texture in the final materials, the hot rolling speed and temperature can be controlled such that full recrystallization (i.e., the self-annealing) of the hot rolled materials is achieved during coiling at the exit of the tandem mill. For self-annealing to occur, the exit temperature is controlled to at least 300° C. Alternatively, batch annealing of the hot rolled coils can be carried out at a temperature of from 350° C. to 450° C. for a period of time. For example, batch annealing can be performed for a soak time of up to 1 hour. In this process, the hot rolling speed and temperature are controlled during the coiling at the exit of the hot tandem mill. In some embodiments, no self-annealing occurs. In some embodiments, the hot rolled coils can then be cold rolled to a final gauge thickness of from 0.1 mm-1.0 mm (e.g., from 0.2 mm-0.9 mm or from 0.3 mm-0.8 mm). In some embodiments, the cold rolling step can be carried out using the minimum number of cold rolling passes. For example, the cold rolling step can be carried out using two cold rolling passes to achieve the desired final gauge. In some embodiments, a heat treatment step is not performed before or after the cold rolling process.

The methods described herein can be used to prepare highly shaped cans and bottles. The cold rolled sheets described above can be subjected to a series of conventional can and bottle making processes to produce preforms. The preforms can then be annealed to form annealed preforms. Optionally, the preforms are prepared from the aluminum alloys using a drawing and wall ironing (DWI) process and the cans and bottles are made according to other shaping processes as known to those of ordinary skill in the art.

The following examples will serve to further illustrate the present invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention.

EXAMPLES

Example 1

Figure 1B:
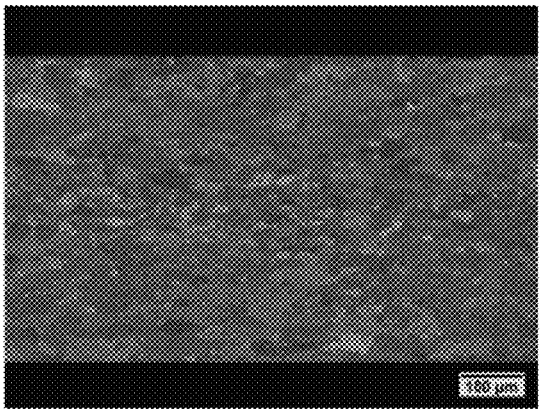
FIG. 1B is a photograph showing the recrystallized grain structure of Mn-containing dispersoid samples that were homogenized at 600° C. for 8 hours.

Alloys were prepared according to the present invention and were homogenized using either the two-step homogenization cycle described herein or the conventional low temperature cycle (i.e., at approximately 540° C.). A recrystallized grain structure was established in each sample using a recrystallization annealing process. The recrystallized grain structure of the sample homogenized in accordance to the two step homogenization cycle described above is shown in FIG. 1*b*. The recrystallized grain size of the sample homogenized using the conventional low temperature cycle (i.e., at approximately 540° C.) is shown in FIG. 1*a*. By comparison, the grain size is significantly finer using the homogenization cycle according to the present invention (i.e., according to the two-step homogenization cycle). Thus, the Mn-containing dispersoids controlled the grain size in the sample during subsequent recrystallization annealing. The finer grain size retarded the material's tendency to form orange peel after drawing and wall ironing (DWI) and during subsequent expansion processes, such as blow molding. Orange peel formation is an undesirable surface defect known to one of ordinary skill in the art.

Example 2

Five alloys, including Alloy H2, Alloy LC, Alloy 0.2 Mg, and Alloy 0.5 Mg, were prepared or obtained for tensile elongation testing (see Table 4). Alloy AA3104 is the conventionally used can body stock alloy, such as the can body stock commercially available from Novelis, Inc. (Atlanta, Ga.). Alloy H2, Alloy LC, Alloy 0.2 Mg, and Alloy 0.5 Mg are prototype alloys prepared for the tensile tests. Alloy H2, Alloy LC, Alloy 0.2 Mg, and Alloy 0.5 Mg were prepared using a two-step homogenization cycle as described herein. Specifically, the ingots having the alloy composition shown below in Table 4 were heated to 615° C. and soaked for 4 hours. The ingots were then cooled to 480° C. and soaked at that temperature for 14 hours to result in Mn-containing dispersoids. The ingots were then hot rolled to a 2 mm thick gauge followed by a batch annealing cycle at 415° C. for 1 hour. Cold rolling was then carried out using two cold rolling passes to a final gauge thickness of approximately 0.45 mm (overall gauge reduction by 78.8%). The elemental compositions of the tested alloys are shown in Table 4, with the balance being aluminum. The elemental compositions are provided in weight percentages.

TABLE 4

| Alloy | Si | Fe | Cu | Mn | Mg | Cr | Zn | Ti |
|---|---|---|---|---|---|---|---|---|
| AA3104 | 0.30 | 0.50 | 0.17 | 0.86 | 1.13 | 0.003 | 0.14 | 0.011 |
| H2 | 0.27 | 0.42 | 0.14 | 1.21 | 0.01 | 0.02 | 0.08 | 0.011 |
| LC | 0.29 | 0.42 | 0.10 | 1.10 | 0.01 | 0.02 | 0.09 | 0.01 |
| 0.2Mg | 0.27 | 0.41 | 0.19 | 1.10 | 0.20 | 0.01 | 0.07 | 0.009 |
| 0.5Mg | 0.30 | 0.47 | 0.20 | 1.22 | 0.48 | 0.02 | 0.10 | 0.04 |

Figure 2A:
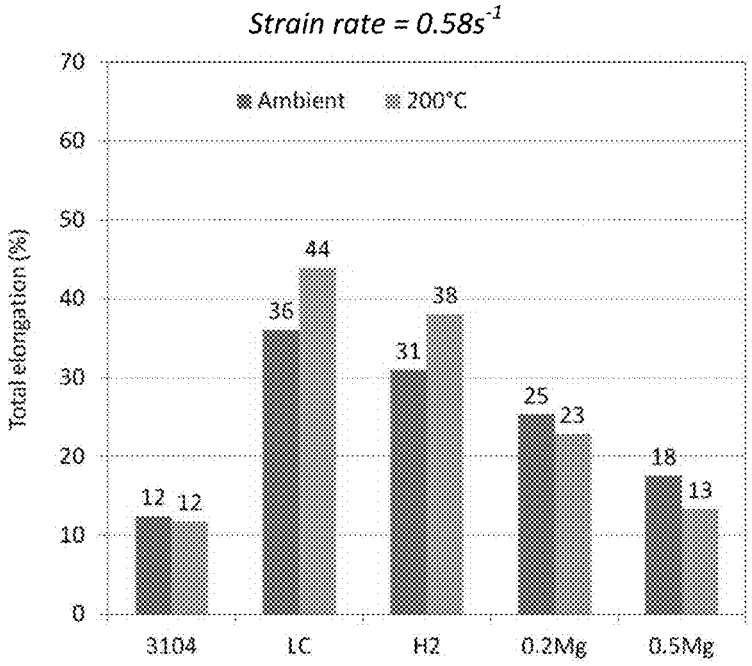
FIG. 2A is a graph showing the total tensile elongation, at a strain rate of 0.58 $s^{-1}$, for the prototype alloys described herein and for comparison alloys.
Figure 2B:
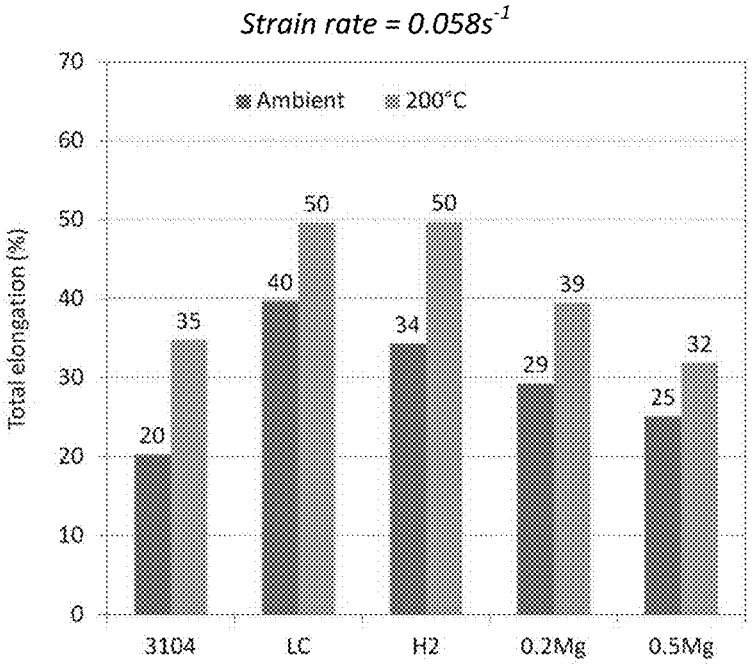
FIG. 2B is a graph showing the total tensile elongation, at a strain rate of 0.058 $s^{-1}$, for the prototype alloys described herein and for comparison alloys.

Tensile elongation data were obtained for each alloy from Table 4. The high temperature tensile tests were carried out in an Instron tensile machine (Norwood, Mass.) equipped with a heating oven. The tensile elongation data obtained from the three prototype alloys and AA3104 were compared, as shown in FIGS. 2*a* and 2*b*. The data obtained from the conventional can body stock 3104 was included as a baseline comparison. All alloys were in their O-tempered conditions prior to tensile testing. FIGS. 2*a* and 2*b* show the elongation data from tests using strain rates of 0.58 $s^{-1}$ and 0.058 $s^{-1}$, respectively.

Alloy AA3104, which contains approximately 1.13 wt. % of Mg, showed poor formability when deformed at the higher strain rate at both ambient temperature and at 200° C., as compared to the three prototype alloys. At the higher strain rate of 0.58 $s^{-1}$, the elongations of Alloy LC and Alloy H2, which each contain 0.01 wt. % Mg, were increased by increasing the temperature from ambient temperature to 200° C. See FIG. 2*a*. However, elongation increases were not observed in the three alloys that contained higher amounts of Mg (i.e., Alloy AA3104, Alloy 0.2 Mg, and Alloy 0.5 Mg).

Comparing Alloy H2 to Alloy 0.2 Mg and Alloy 0.5 Mg shows that the addition of 0.2 wt. % and 0.5 wt. % of Mg retarded the increase in formability associated with the increase in forming temperature (see FIG. 2*a*). All four prototype alloys, i.e., Alloy LC, Alloy H2, Alloy 0.2 Mg, and Alloy 0.5 Mg tended to show higher total elongation than AA3104 alloys at both low and high strain rates. The addition of Mg significantly reduced the high temperature formability of the alloys when the forming operation was carried out at a higher strain rate, which is an unexpected effect resulting from Mg addition.

Example 3

To illustrate the superior high strain rate formability of the H2 and LC alloys at elevated temperatures, blow forming experiments were performed using Alloy H2, Alloy LC, and Alloy 0.2 Mg from Example 2 above. The as-cold rolled sheets were subjected to a series of conventional can making processes, using cuppers and body makers, to produce preforms. The preforms were then subjected to an annealing operation. The annealed preforms were tested in a blow forming apparatus to evaluate the high strain rate formability of the materials at elevated temperatures. The blow forming experiments were conducted at 250° C. The strain rate the materials were subjected to during the forming process was approximately 80 $s^{-1}$. The results are summarized in Table 5 and provided in terms of the maximum percent expansion, which is the ratio between the original diameter of the preforms and the final diameter of the containers after blow forming.

TABLE 5

| Alloys | Maximum percent expansion ratio |
|---|---|
| LC | 40% |
| H2 | 40% |
| 0.2Mg | 30% |

The superior formability of LC and H2 alloys (having low Mg contents) is observed by comparing the results shown in Table 5. Specifically, both alloys achieved a 40% expansion without premature failure. In contrast, the maximum expansion ratio of the 0.2 Mg alloys was only 30%.

All patents, patent applications, publications, and abstracts cited above are incorporated herein by reference in their entirety. Various embodiments of the invention have been described in fulfillment of the various objectives of the invention. It should be recognized that these embodiments are merely illustrative of the principles of the present invention. Numerous modifications and adaptations thereof will be readily apparent to those of skill in the art without departing from the spirit and scope of the invention as defined in the following claims.

What is claimed is:

1. An aluminum alloy comprising 0.25-0.35 wt. % Si, 0.40-0.60 wt. % Fe, 0-0.40 wt. % Cu, 1.1-1.2 wt. % Mn, 0-0.50 wt. % Mg, 0.001-0.03 wt. % Cr, 0-0.3 wt. % Zn, up to 0.15 wt. % of impurities, with the remainder as Al, wherein the alloy includes Mn-containing dispersoids and wherein the alloy exhibits an increased elongation, as compared to an AA3104 alloy, when the alloy is subjected to a strain rate of at least 0.5 $s^{-1}$ at a temperature up to 250° C.

2. The aluminum alloy of claim 1, comprising 0.25-0.35 wt. % Si, 0.40-0.50 wt. % Fe, 0.08-0.22 wt. % Cu, 1.1-1.2 wt. % Mn, 0-0.5 wt. % Mg, 0.001-0.03 wt. % Cr, 0.07-0.13 wt. % Zn, up to 0.15 wt. % of impurities, with the remainder as Al.

3. The aluminum alloy of claim 1, comprising 0.25-0.30 wt. % Si, 0.40-0.45 wt. % Fe, 0.10-0.20 wt. % Cu, 1.1-1.2 wt. % Mn, 0-0.25 wt. % Mg, 0.003-0.02 wt. % Cr, 0.07-0.10 wt. % Zn, up to 0.15 wt. % of impurities, with the remainder as Al.

4. The aluminum alloy of claim 1, wherein the alloy includes Mg in an amount of 0.10 wt. % or less.

5. The aluminum alloy of claim 1, wherein the Mn-containing dispersoids each have a diameter of 1 μm or less.

6. The aluminum alloy of claim 1, wherein the alloy is produced by direct chill casting.

7. The aluminum alloy of claim 6, wherein the alloy is produced by homogenization, hot rolling, and cold rolling.

8. The aluminum alloy of claim 1, wherein the alloy is produced by a two-stage homogenization cycle.

9. A bottle comprising the aluminum alloy of claim 1.

10. A can comprising the aluminum alloy of claim 1.

11. An aluminum alloy comprising 0.25-0.35 wt. % Si, 0.40-0.60 wt. % Fe, 0-0.40 wt. % Cu, 1.1-1.2 wt. % Mn, 0-0.20 wt. % Mg, 0.001-0.03 wt. % Cr, 0-0.3 wt. % Zn, up to 0.15 wt. % of impurities, with the remainder as Al, wherein the alloy includes Mn-containing dispersoids and wherein the alloy exhibits a total elongation of at least 20% when the alloy is subjected to a strain rate of at least 0.5 $s^{-1}$ at a temperature up to 250° C.

12. The aluminum alloy of claim 11, comprising 0.25-0.35 wt. % Si, 0.40-0.50 wt. % Fe, 0.08-0.22 wt. % Cu, 1.1-1.2 wt. % Mn, 0-0.2 wt. % Mg, 0.001-0.03 wt. % Cr, 0.07-0.13 wt. % Zn, up to 0.15 wt. % of impurities, with the remainder as Al.

13. The aluminum alloy of claim 11, comprising 0.25-0.30 wt. % Si, 0.40-0.45 wt. % Fe, 0.10-0.20 wt. % Cu, 1.1-1.2 wt. % Mn, 0-0.15 wt. % Mg, 0.003-0.02 wt. % Cr, 0.07-0.10 wt. % Zn, up to 0.15 wt. % of impurities, with the remainder as Al.

14. The aluminum alloy of claim 11, wherein the alloy includes Mg in an amount of 0.10 wt. % or less.

15. The aluminum alloy of claim 14, wherein the total elongation is at least 25%.

16. The aluminum alloy of claim 14, wherein the total elongation is at least 30%.

17. A bottle comprising the aluminum alloy of claim 11.

18. A can comprising the aluminum alloy of claim 11.

* * * * *